United States Patent [19]

Leifeld

[11] Patent Number: 4,701,981

[45] Date of Patent: Oct. 27, 1987

[54] APPARATUS FOR PNEUMATICALLY FEEDING A PLURALITY OF CARDING MACHINES

[75] Inventor: Ferdinand Leifeld, Kempen, Fed. Rep. of Germany

[73] Assignee: Trützschler GmbH & Co. KG, Monchen-Gladbach, Fed. Rep. of Germany

[21] Appl. No.: 799,971

[22] Filed: Nov. 20, 1985

[30] Foreign Application Priority Data

Nov. 24, 1983 [DE] Fed. Rep. of Germany ..... 3442942

[51] Int. Cl.[4] ..... D01G 15/40

[52] U.S. Cl. ..... 19/105; 19/300; 406/156

[58] Field of Search ..... 19/105, 97.5, 205, 300; 406/156

[56] References Cited

U.S. PATENT DOCUMENTS

| | | | |
|---|---|---|---|
| 3,145,426 | 8/1964 | Hijiya et al. | 19/105 |
| 3,645,305 | 2/1972 | Warlop | 19/105 X |
| 3,649,082 | 3/1972 | Wise | 19/105 X |
| 3,667,087 | 6/1972 | Dakin et al. | 19/105 |
| 4,045,091 | 8/1977 | Beneke | 19/105 X |
| 4,219,289 | 8/1980 | Trutzschler | 19/105 X |
| 4,240,180 | 12/1980 | Wood et al. . | |

FOREIGN PATENT DOCUMENTS

| | | |
|---|---|---|
| 804544 | 4/1951 | Fed. Rep. of Germany . |
| 909430 | 4/1954 | Fed. Rep. of Germany . |
| 1510275 | 2/1970 | Fed. Rep. of Germany . |
| 2050111 | 4/1971 | Fed. Rep. of Germany . |
| 2359917 | 6/1974 | Fed. Rep. of Germany . |
| 7337570 | 9/1975 | Fed. Rep. of Germany . |
| 2413249 | 10/1975 | Fed. Rep. of Germany . |
| 2834586 | 2/1983 | Fed. Rep. of Germany . |
| 3315909 | 8/1984 | Fed. Rep. of Germany . |
| 3328358 | 2/1985 | Fed. Rep. of Germany . |

*Primary Examiner*—Louis K. Rimrodt
*Assistant Examiner*—J. L. Olds
*Attorney, Agent, or Firm*—Spencer & Frank

[57] ABSTRACT

An installation for pneumatically supplying fiber material to a plurality of carding machines arranged for simultaneous operation includes a plurality of card feeders, each being operatively connected to a separate carding machine. Each card feeder has a feed chute delivering fiber material to the carding machine associated therewith and a reserve chute delivering fiber material to the feed chute associated therewith. The installation further has a common transport conduit connected to the reserve chute of each card feeder and a fan contained in the common transport conduit for advancing fiber material by an air stream to the card feeders and a control arrangement for varying the flow rate of the fiber material in the common transport conduit as a function of at least one operational parameter of the installation.

11 Claims, 7 Drawing Figures

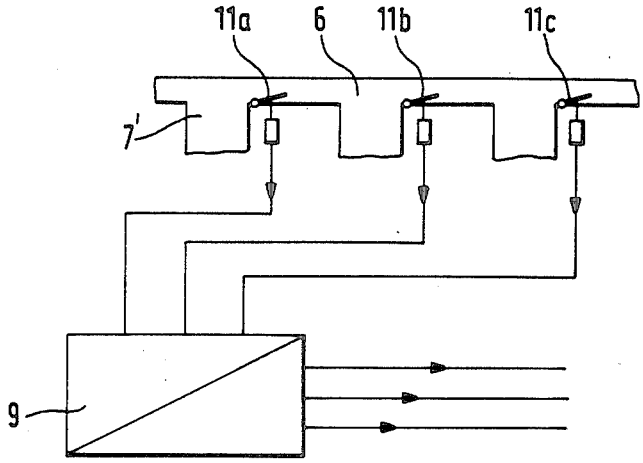
Fig.4
Fig.5
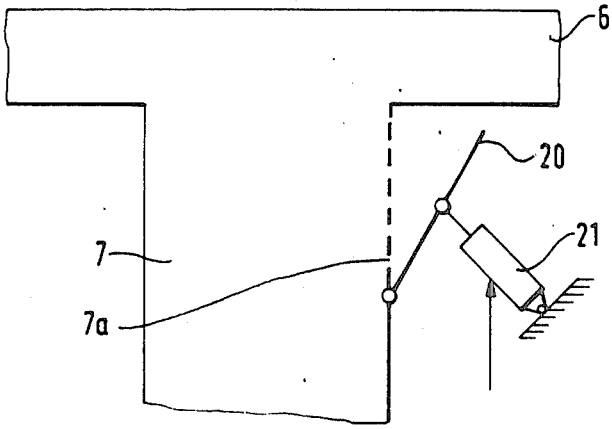

APPARATUS FOR PNEUMATICALLY FEEDING A PLURALITY OF CARDING MACHINES

BACKGROUND OF THE INVENTION

This invention relates to an apparatus for pneumatically feeding fiber material to a plurality of carding machines with the intermediary of separate reserve chutes connected to each carding machine upstream thereof as viewed in the direction of material advance. The reserve or upper chutes, in turn, are coupled to a common pneumatic conveyor conduit and advance the fiber material to downstream-connected feed chutes. The fiber transporting conveyor conduit is coupled with an upstream located fiber processing machine, such as a fine opener and contains a fiber-transporting fan.

In a dual-chute card supplying arrangement as disclosed, for example, in U.S. Pat. No. 4,219,289 (issued Aug. 26, 1980) the filling conditions in the upper chute (reserve chute) are not allowed to greatly deviate from the desired normal conditions if a satisfactory uniformity of the fiber lap, as concerns width and time are to be ensured. It is noted that by "filling conditions" there are meant the material quantities in the upper chute, the compression and distribution of the material as well as the shape and size of the material accumulation on the separating surface. The filling conditions in the upper chute depend, among others, from the tuft-air ratio, the tuft size, the air resistance of the separating surface, that is, the shape and size thereof, the transport speed of the fiber tufts, the rate of air discharge and the velocity of air exit at the separating surfaces. Some of these magnitudes depend from the static air pressure, the air quantities and the velocity in the conveyor ducts (transport conduits) leading to the feed chutes. These last-named parameters, in turn, are determined by the operating point of the upstream-connected fan and the filling conditions at the separating surfaces of all downstream-arranged upper feed chutes as well as the geometry of the transport conduits. If fluctuations are maintained within certain narrow limits, satisfactory results can be obtained. The magnitudes of fluctuation are determined by the number of momentarily operating (that is, fiber-consuming) carding machines, the momentary flow rate of material per location, the extent of fiber opening performed on the material supplied to each location as well as the gliding properties and the air resistance of the material. Upon output fluctuations at the individual carding machines, as well as by starting and stopping the carding machines and by density fluctuations in the fiber supply, determined by an upstream-connected cleaning line, the filling conditions often change beyond permissible limits. It is necessary to perform modifications at a number of locations in order to adapt the filling conditions to the changed conditions of the material and the number of the connected carding machines. This is effected in practice usually only during a new setting of the equipment and involves significant expense. Despite such measures there remain, even during a preselected and desired operational condition of a fiber processing system, fluctuations of the filling conditions which are caused by changes during operation. Thus, in the case of each individual carding machine the output speed may change, for example, during coiler can replacement, operational disturbances, verifications, and the like or in case strongly fluctuating material quantities are supplied by the feeding fan into the conveyor duct system which feeds the upper feed chutes (reserve chutes).

In a known apparatus the basic speed of the fiber transport fan is set upon the first production of a predetermined lot for a given number of cards. Upon change of the lot type or a change of the number of cards, for example, because of retooling, interruption in operation, start or stoppage or the like, belt pulleys have to be replaced in order to change the basic speed of the fan and thus the air quantities and/or air velocities in the transport duct and in the reserve chutes of the card feeders. Such an apparatus has therefore the disadvantage that upon change in the composition of a lot or the number of operating cards, the conditions of air flow in the conveying duct may be adjusted only with a significant input of labor which is very time-consuming and causes long down periods.

SUMMARY OF THE INVENTION

It is an object of the invention to provide an improved apparatus of the above-outlined type from which the discussed disadvantages are eliminated, which permits a particularly simple and rapid adaptation of the air flow conditions in the conveyor duct and in the reserve chute to new conditions upon alteration of a fiber lot or the number of the operating associated carding machines.

This object and others to become apparent as the specification progresses, are accomplished by the invention, according to which, briefly stated, the air quantities and/or the air velocity in the conveyor duct is set as a function of lot-specific data or as a function of the number of the associated, momentarily operating carding machines.

By virtue of the fact that the air quantities and/or the air velocity in the conveyor duct is set as a function of the lot-specific data or as a function of the number of the operating carding machines, a simple and rapid adaptation of the air flow conditions in the conveyor duct or in the reserve chute may be achieved in case of a change in the fiber lot or a change in the number of operating cards.

Expediently, the dominantly determinative magnitude, such as lot-specific data (type or fineness of material and the like) and the number of the operating carding machines are determined and/or measured and after an evaluation of these magnitudes, the operation of the supply fan (rpm, flow rate and pressure of air) and - alternatively or additively-the magnitude of the supply channel cross section and/or separating surfaces on the upper chutes of the card feeders are adjusted. These changes are performed automatically and in a preprogrammed manner during resetting of the system and also, during its operation to compensate for operational fluctuations.

BRIEF DESCRIPTION OF THE DRAWING

FIG. 4 is a diagrammatic fragmentary elevational view of a fiber supplying system according to still another preferred embodiment of the invention.

FIG. 5 is a schematic elevational view of a further feature according to the invention.

DESCRIPTION OF THE PREFERRED EMBODIMENTS

Figure 1A:
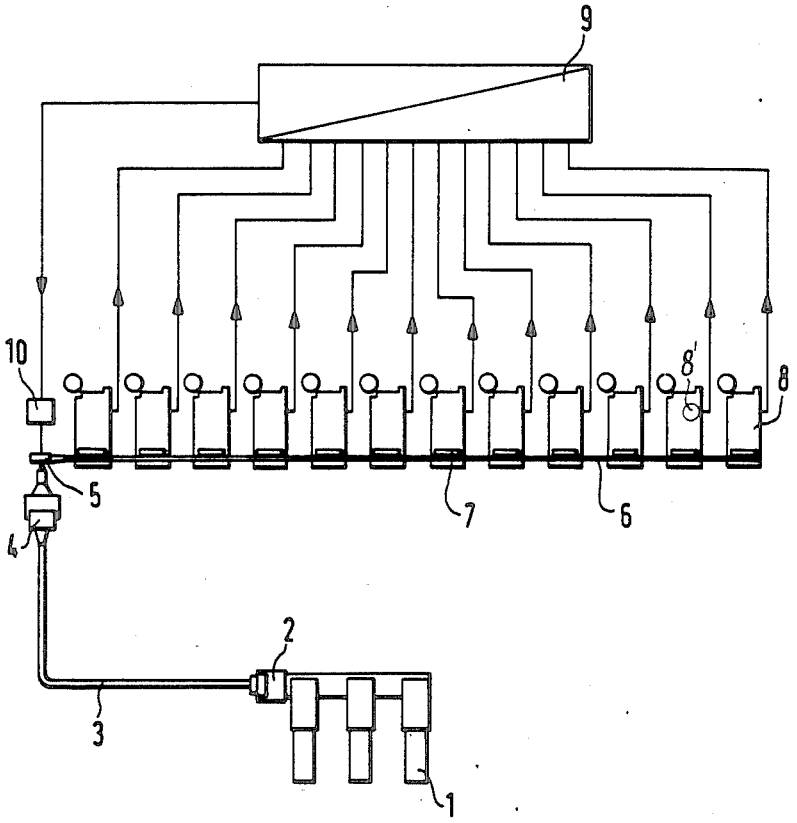
FIG. 1*a* is a diagrammatic top plan view of a preferred embodiment of the invention, including a plurality of carding machines, each shown in an operating condition.
Figure 1B:
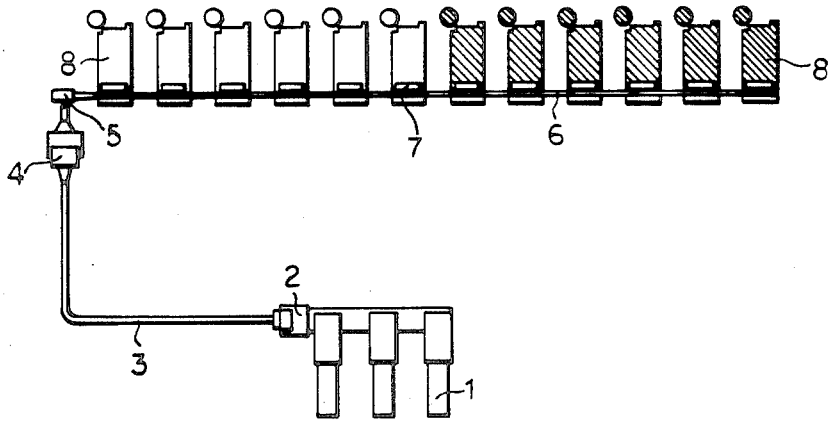
FIG. 1*b* is a diagrammatic illustration, similar to FIG. 1*a*, wherein only some of the carding machines are in an operating state.

Turning to FIGS. 1*a* and 1*b*, there is illustrated therein a fiber tuft blending installation which has a plurality of feeders 1 equipped with weighing scales and an adjoining tuft blender 2 from which the fiber material is conveyed through a duct 3 to a fine opening assembly 4 which is formed of a condenser, a supply chute, a fine opener and a transport fan 5. The latter pneumatically advances the opened fiber material through a transport duct 6 to the card feeders 7, each supplying a separate, associated carding machine 8. While in the illustration according to FIG. 1*a*, all twelve cards 8 are in the state of processing fiber material, in the illustration according to FIG. 1*b*, fiber material is supplied only to six cards 8 which process the fiber material while the other six cards 8 are at a standstill.

Reverting to FIG. 1*a*, the electric drives 8' of the cards 8 are connected to a control device 9. Electric magnitudes (measuring values) representing the rpm of one or several rolls of the cards 8 are applied to the control device 9. The electric magnitudes may be taken directly from the drives or from a tachometer connected therewith. The output of the control apparatus 9 is connected with the drive motor 10 of the fiber conveying fan 5. If, according to FIG. 1*b*, in which the control apparatus 9 is not shown, six cards 8 are at a standstill then, according to the rpm of six operating carding machines 8, the rpm of the drive motor 10 is reduced whereupon the fan 5 delivers a reduced air quantity. In this manner, the air quantity is preselected as a function of the number of operating cards 8 or is automatically set wherein in case of a larger number of cards a larger rate of air flow and in case of a lower number of operating cards a lower rate of air flow will be set.

Figure 2:
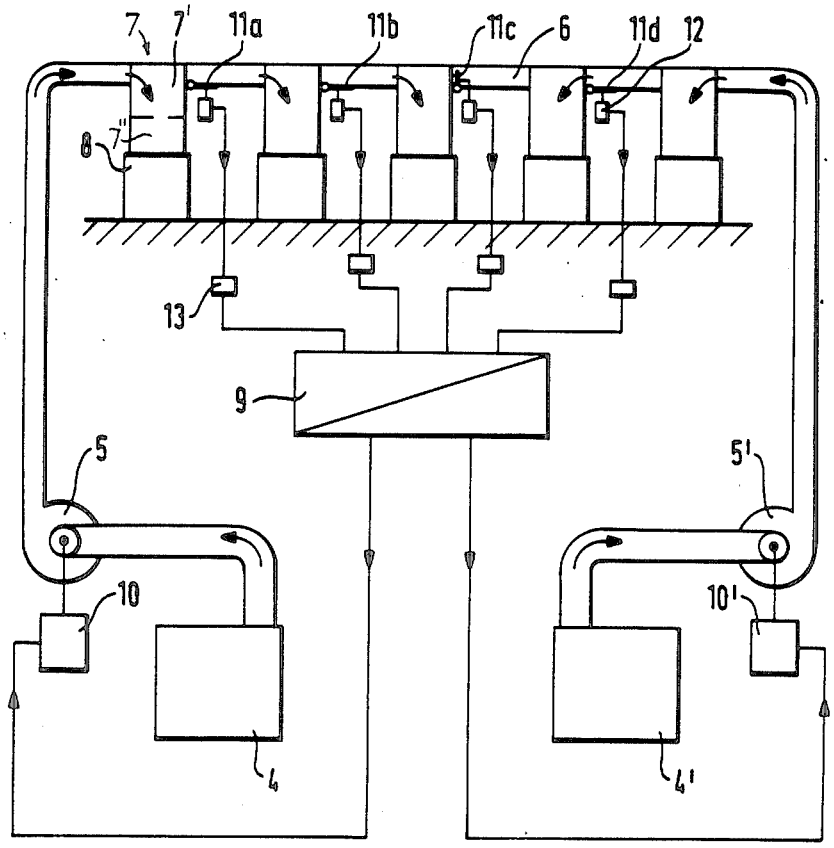
FIG. 2 is a diagrammatic elevational view of a fiber supplying system according to another preferred embodiment of the invention.

Turning to FIG. 2, there is illustrated a card feeding installation, for example, a "FLEXAFEED" model manufactured by Trützschler GmbH & Co. KG, Mönchengladbach, Federal Republic of Germany, in which the conveying duct 6 is connected to two fiber transporting fans 5 and 5' associated with a separate opener and cleaner 4, 4' so that fiber material is introduced into the conveyor duct 6 from two opposite ends to the reserve chute 7' of each card feeder 7. From each reserve chute 7' material is advanced to an associated feed chute 7''. The purpose of the installation is to introduce simultaneously different types of fiber material, for example, cotton and chemical fibers into the conveyor duct 6 for processing by the cards 8. At the head of each card feeder 7 or, stated differently, between each adjoining card feeder 7 there is provided a separate, pneumatically operated shutoff gate 11*a*–11*d* which is actuated, for example, by a power cylinder symbolically shown at 12 and which divides the conveyor duct 6 into two zones in which the two different fiber material types are introduced. Thus, in FIG. 2, the gate 11*c* is in a closed position, as a result of which the first three cards 8 (counted from the left) receive material from the cleaner 4 and the last two cards 8 receive material from the cleaner 4'. The power cylinders 12 are in each instance electrically connected by means of a transducer 13 with the control apparatus 9 whose outputs are connected with the drive motors 10 and 10' associated with the respective fans 5 and 5'. When the position of the shutoff gates 11*a*, 11*b*, 11*c* and 11*d* changes, the control apparatus 9 varies the rpm of the drive motors 10 and 10' so that, accordingly, the fans 5 and 5' deliver more or less air. In this manner, the air quantity and thus the basic fan rpm is automatically adjusted as a function of the position of the shutoff gates 11*a*–11*d*.

Figure 3:
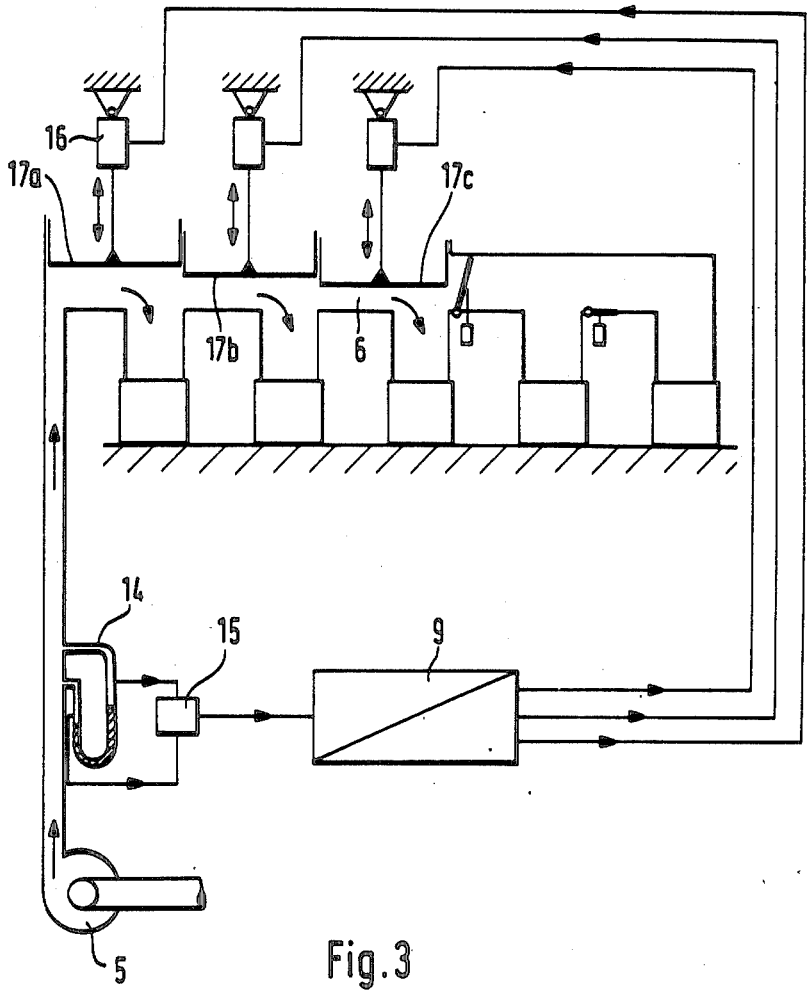
FIG. 3 is a diagrammatic elevational view of a fiber supplying system according to still another preferred embodiment of the invention.

Turning now to FIG. 3, downstream of the conveyor fan 5 the conveyor duct 6 contains a flow rate measuring device 14 which is electrically connected with the control (and/or regulating) apparatus 9 by means of a transducer 15. The outputs of the control apparatus 9 are pneumatically connected with setting devices, for example, pressure cylinders 16 which operate devices for changing the cross-sectional passage area of the conveyor duct 6. For this purpose, the latter may have, for example, a plurality of wall elements 17*a*, 17*b* and 17*c* which may be shifted towards or away from the opppositely located wall portions, so that the cross section of the conveyor duct 6 may be reduced or enlarged. The wall elements 17*a*–17*c* may be made of an elastic material (for example, rubber or the like) to thus ensure an advantageous seal. According to the embodiment illustrated in FIG. 3, the cross-sectional area of the conveyor duct 6 is changed in such a manner as a function of the air quantities that the value of the desired flow speed is maintained.

Turning now to FIG. 4, the control apparatus 9 (as opposed to the showing in FIG. 3) is connected with the shutoff gates 11*a*–11*c* at the head of the reserve chutes 7'. In this manner, the cross-sectional area of the conveyor duct 6 is preselected as a function of the position of the shutoff gates.

According to FIG. 5, a lateral wall of the reserve chute 7' is provided with air outlet openings 7*a* which may be closed by a gate 20 rotatably supported at one end at the chute wall. The position of the gate 20 may be varied by a power cylinder 21 which is connected with the control apparatus 9 (not shown in FIG. 5).

Figure 6:
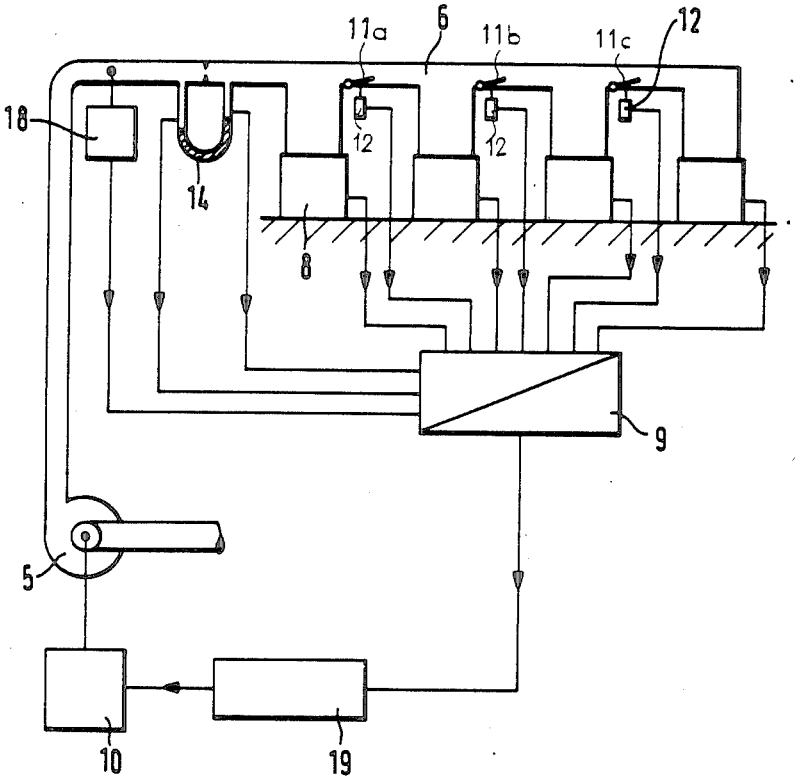
FIG. 6 is a diagrammatic elevational view of a further embodiment of the invention, including a central computer.

Turning now to FIG. 6, to the conveyor duct 6 there are connected a pressure measuring device 18 and a flow rate measuring device 14. The pressure measuring device 18, the flow rate measuring device 14, the driving devices of the cards 8 and the power cylinders 12 for the shutoff gates 11 are electrically connected by means of transducers (not shown) to a central control apparatus 9 (for example, a regulator or computer system) which may be a microcomputer with a microprocessor for calculating cross-relationships between measuring and setting magnitudes. The microcomputer may be a TMS model, manufactured by Trützschler GmbH & Co. KG, Mönchengladbach, Federal Republic of Germany. The output of the control apparatus 9 is connected with the drive motor 10 for the fan 5 by means of a motor control 19. The values for the air pressure, the air quantities, the air speed and the number of the operating cards 8 are applied individually or together to the control apparatus (regulator or computing system) 9 which processes the data and affects the rpm of the supply fan 5 and/or the cross-sectional area of the conveyor duct 6. Expediently, the control apparatus 9 is associated with a non-illustrated data memory (automatic desired value setter). In the memory there are stored the required rpm's, for example, for the conveyor fan 5 for determined types of fiber material (lots) or for a desired number of operating cards 8. According to these parameters, the fan rpm may be automatically or manually set or adapted in case of changes.

Advantageously, first the basic settings for the fan 5 and/or the cross-sectional area of the conveyor duct 6 are computed and fed to the apparatus. On such a signal there is superposed an additional regulating or setting magnitude whose value is derived from the momentary deviations of actual values from the desired values for the air speed, and/or air quantities and/or air pressure. The regulating apparatus 9 cooperates with a regulating apparatus which regulates the quantity of the supplied fiber tufts. Also, the regulating apparatus 9 may cooperate with a regulating apparatus which calls and/or monitors and/or regulates the card output. Instead of a supply fan 5 it is feasible to regulate, in the same manner, the rpm of a suction fan forming part of a system which effects fiber tuft conveyance by air suction flows.

It will be understood that the above description of the present invention is susceptible to various modifications, changes and adaptations, and the same are intended to be comprehended within the meaning and range of equivalents of the appended claims.

What is claimed is:

1. In an installation for pneumatically supplying fiber material to a plurality of carding machines arranged for simultaneous operation; said installation including a plurality of card feeders, each being operatively connected to a separate said carding machine; each card feeder having a feed chute delivering fiber material to the carding machine associated therewith and a reserve chute delivering fiber material to the feed chute associated therewith; a common transport conduit connected to the reserve chute of each said card feeder and fan means contained in said common transport conduit for advancing fiber material by an air stream through said common transport conduit to said card feeders, the improvement comprising control means for varying a flow rate of the air stream in said common transport conduit as a function of at least one operational parameter selected from the group consisting of parameters pertaining to lot-specific data of the fiber material and the quantity of momentarily operating carding machines.

2. An installation as defined in claim 1, wherein each said carding machine has a drive means for operating the carding machine; further wherein said control means includes a control device having an input connected with each said drive means of said carding machines.

3. An installation as defined in claim 1, further comprising a plurality of shutoff gates in said common transport conduit; a separate said shutoff gate being positioned between adjoining two reserve chutes; each shutoff gate having open and closed positions; further wherein said control means has an input connected to said shutoff gates to determine the position of each of said shutoff gates.

4. An installation as defined in claim 1, wherein said control means includes a control apparatus having an output; further comprising a driving means for operating said fan means with a predetermined speed; said driving means of said fan means being connected to said output for varying said predetermined speed as a function of said at least one operational parameter for varying a flow velocity of said air stream in said common transport conduit.

5. An installation as defined in claim 1, wherein said control means includes a control apparatus having an output; further comprising a movable throttle means contained in said common transport conduit for varying a cross-sectional passage area of said common transport conduit; said movable throttle means being connected to said output for varying said cross-sectional passage area.

6. An installation as defined in claim 5, wherein said movable throttle means includes elastic throttle elements.

7. An installation as defined in claim 6, wherein said elastic throttle elements are rubber elements.

8. An installation as defined in claim 1, wherein said control means includes a control apparatus having an output; further comprising means defining an air outlet opening in each said reserve chute and separate mechanisms associated with each air outlet opening for controlling air flow therethrough; each mechanism being connected with said output of said control apparatus.

9. An installation as defined in claim 8, wherein said mechanisms comprise a pneumatic actuating device.

10. An installation as defined in claim 1, wherein said control means includes a control apparatus; further comprising a data memory operatively connected with said control apparatus.

11. An installation as defined in claim 1, wherein said control means includes a control apparatus constituted by a microcomputer.

* * * * *

UNITED STATES PATENT AND TRADEMARK OFFICE

CERTIFICATE OF CORRECTION

PATENT NO. : 4,701,981

DATED : October 27th, 1987

INVENTOR(S) : Ferdinand Leifeld

It is certified that error appears in the above-identified patent and that said Letters Patent is hereby corrected as shown below:

In the heading of the patent, under [30] the foreign application priority date should read --Nov. 24, 1984--.

Signed and Sealed this

Twenty-ninth Day of March, 1988

*Attest:*

DONALD J. QUIGG

*Attesting Officer*

*Commissioner of Patents and Trademarks*